US006365017B1

(12) United States Patent
Hongo et al.

(10) Patent No.: US 6,365,017 B1
(45) Date of Patent: Apr. 2, 2002

(54) SUBSTRATE PLATING DEVICE

(75) Inventors: Akihisa Hongo; Naoaki Ogure; Hiroyuki Ueyama; Junitsu Yamakawa; Mizuki Nagai; Kenichi Suzuki; Atsushi Chono; Satoshi Sendai; Koji Mishima, all of Tokyo (JP)

(73) Assignee: Ebara Corporation, Tokyo (JP)

( * ) Notice: Subject to any disclaimer, the term of this patent is extended or adjusted under 35 U.S.C. 154(b) by 0 days.

(21) Appl. No.: 09/530,805

(22) PCT Filed: Sep. 8, 1999

(86) PCT No.: PCT/JP99/04861

§ 371 Date: May 5, 2000

§ 102(e) Date: May 5, 2000

(87) PCT Pub. No.: WO00/14308

PCT Pub. Date: Mar. 16, 2000

(30) Foreign Application Priority Data

| | | |
|---|---|---|
| Sep. 8, 1998 | (JP) | 10-254395 |
| Sep. 8, 1998 | (JP) | 10-254396 |
| Mar. 11, 1999 | (JP) | 11-064987 |
| Mar. 11, 1999 | (JP) | 11-064988 |

(51) Int. Cl.[7] ..... C25D 17/00; C25B 11/00

(52) U.S. Cl. ..... 204/212; 204/257; 204/263; 204/264; 204/224 R; 204/282

(58) Field of Search ..... 204/237, 238, 204/263, 257, 252, 224 R, 264, 212

(56) References Cited

U.S. PATENT DOCUMENTS

| | | | | |
|---|---|---|---|---|
| 3,450,625 A | * | 6/1969 | Ramsey et al. | 204/237 |
| 4,469,564 A | * | 9/1984 | Okinaka et al. | 204/252 X |
| 4,906,340 A | * | 3/1990 | Brown | 204/237 X |
| 5,009,755 A | * | 4/1991 | Shor | 204/252 X |

FOREIGN PATENT DOCUMENTS

| | | |
|---|---|---|
| JP | 2-70087 | 3/1990 |
| JP | 3-10099 | 1/1991 |
| JP | 5-302199 | 11/1993 |
| JP | 10-121297 | 5/1998 |

* cited by examiner

*Primary Examiner*—Donald R. Valentine
(74) *Attorney, Agent, or Firm*—Wenderoth, Lind & Ponack, L.L.P.

(57) ABSTRACT

The present invention relates to a substrate plating apparatus for plating a substrate in a plating bath containing plating solution. An insoluble anode is disposed in the plating bath opposite the substrate. The substrate plating apparatus comprises a circulating vessel or dummy vessel provided separate from the plating bath, with a soluble anode and a cathode disposed in the circulating vessel or dummy vessel. An anion exchange film or selective cation exchange film is disposed between the anode and cathode and isolates the same, wherein metal ions are generated in the circulating vessel or dummy vessel by flowing current between the soluble anode and the cathode therein, and the generated metal ions are supplied to the plating bath. The substrate plating apparatus can also comprise an ion exchange film or neutral porous diaphragm disposed between the substrate and anode in the plating bath, wherein the ion exchange film or neutral porous diaphragm divides the plating bath into a substrate region and an anode region.

34 Claims, 10 Drawing Sheets

SUBSTRATE PLATING DEVICE

TECHNICAL FIELD

The present invention relates to a substrate plating apparatus for performing a metal plating process on a substrate such as a semiconductor wafer.

BACKGROUND ART

FIG. 1 shows the general structure for this type of a conventional substrate plating apparatus. As shown in FIG. 1, a substrate plating vessel 101 accommodates a plating solution Q. Disposed within the substrate plating vessel 101 are a substrate 102, such as a semiconductor wafer; an anode 103 positioned opposite the substrate 102; and a shielding plate 104 interposed between the substrate 102 and anode 103. A power source 106 applies a predetermined voltage between the substrate 102 and anode 103 for forming a plating film on the surface of the substrate 102. A collecting gutter 105 is provided for collecting plating solution Q that overflows from the top end of the substrate plating vessel 101.

When suing a soluble electrode (have phosphorous copper) for the anode 103 in the substrate plating apparatus described above, it is necessary not only to regularly replace the anode but also to process black film on the surface of the electrode and take measures for generated particles. Since this type of substrate plating apparatus is normally provided with a plurality of substrate plating vessels 101, upkeep of the anode 103 can be considerably time-consuming.

One method of attempting to correct these problems is to use an anode formed of an insoluble material in the plate processing vessel. While this material has the advantage of suppressing the existence of particles around the substrate 102, it gives rise to the necessity for replenishing $Cu^{2+}$ ions. $Cu^{2+}$ ions can be added by supplying copper oxide powder or $CuSO_4$—$5H_2O$ powder, or by supplying a highly concentrated solution of $CuSO_4$—$5H_2O$. However, supplying powder is not appropriate for an automated process. Further, adding a solution gradually increases the overall amount of liquid, thus requiring that the plating solution be periodically discharged.

To improve the uniformity of the plating film thickness formed on the surface of the substrate 102 in the plating vessel described above, it is best to ensure that the primary current distribution between the cathode (substrate 102) and the anode 103 is uniform. One way to ensure a uniform distribution of the current is to increase the distance between the cathode and the anode 103. However, this requires a larger substrate plating vessel 101, and consequently, a larger plating apparatus, which is contrary to the object of decreasing the size of the plating apparatus.

When the electrolytic plating conducted is copper plating, for example, the soluble anode often includes phosphorus copper. However, it is difficult to manage the black film formed on the surface of this soluble anode, and the black film produces particle contaminants that can be a large problem. This problem can be overcome by using an insoluble anode. However, insoluble anodes give rise to the problem of how to supply Cu ions to the plating solution, as well as the problem of the additive dissolving and becoming deposited on the semiconductor wafer or other substrate.

DISCLOSURE OF INVENTION

In view of the foregoing, it is an object of the present invention to provide a substrate plating apparatus employing an insoluble anode, and particularly a substrate plating apparatus capable of easily and automatically supplying metal ions.

It is another object of the present invention to provide a substrate plating apparatus capable of supplying a uniform primary current distribution between the cathode and anode and facilitating reduction of the size of the plating apparatus.

It is further another object of the present invention to provide a plating apparatus capable of preventing the substrate from being contaminated by particles produced from black film, even when using a soluble anode.

These objects and others will be attained with a substrate plating apparatus for plating a substrate in accordance with the present invention. The substrate plating apparatus comprises a plating bath containing plating solution. A substrate is disposed in the plating bath and serves as a cathode. A insoluble anode is disposed in the plating bath opposite the substrate. A circulating vessel or dummy vessel is provided separate from the plating bath. A soluble anode is disposed in the circulating vessel or dummy vessel. A cathode is disposed in the circulating vessel or dummy vessel opposite the soluble anode. An anion exchange film or selective cation exchange film is disposed between the anode and cathode and isolates the same. And also provided is an ion replenishing system for creating a current between the anode and cathode to generate and supply metallic ions to the plating bath.

The substrate plating apparatus described above is constructed with a circulating vessel or dummy vessel separate from the plating bath, such that metal ions generated from the soluble anode in the circulating vessel or dummy vessel are supplied to the plating bath. With this construction, it is possible to supply metal ions automatically. Further, this construction eliminates the need to perform cumbersome jobs associated with conventional devices, such as regularly replacing the anode in the plating bath and taking measures to treat black film generated on the surface of the anode.

According to another aspect of the present invention, a substrate plating apparatus for plating a substrate comprises a plating bath containing plating solution. A substrate is disposed in the plating bath. An anode is disposed in the plating bath opposite the substrate. And, an ion exchange film or neutral porous diaphragm is disposed between the substrate and anode in the plating bath, wherein the ion exchange film or neutral porous diaphragm divides the plating bath into a substrate region and an anode region.

The ion exchange film or neutral porous diaphragm provided between the substrate and anode serves to increase the electrical resistance of the plating solution, achieving the same effects as increasing the distance between the substrate and the anode. Accordingly, it is possible to dispose the substrate and anode close together.

Further, the cation exchange film allows the passage of ions dissolved from the anode and blocks impurities dissolved from the anode. Accordingly, the amount of particles in the plating solution in the substrate region can be greatly reduced.

BEST MODE FOR CARRYING OUT THE INVENTION

A substrate plating apparatus according to preferred embodiments of the present invention will be described while referring to the accompanying drawings.

Figure 1:
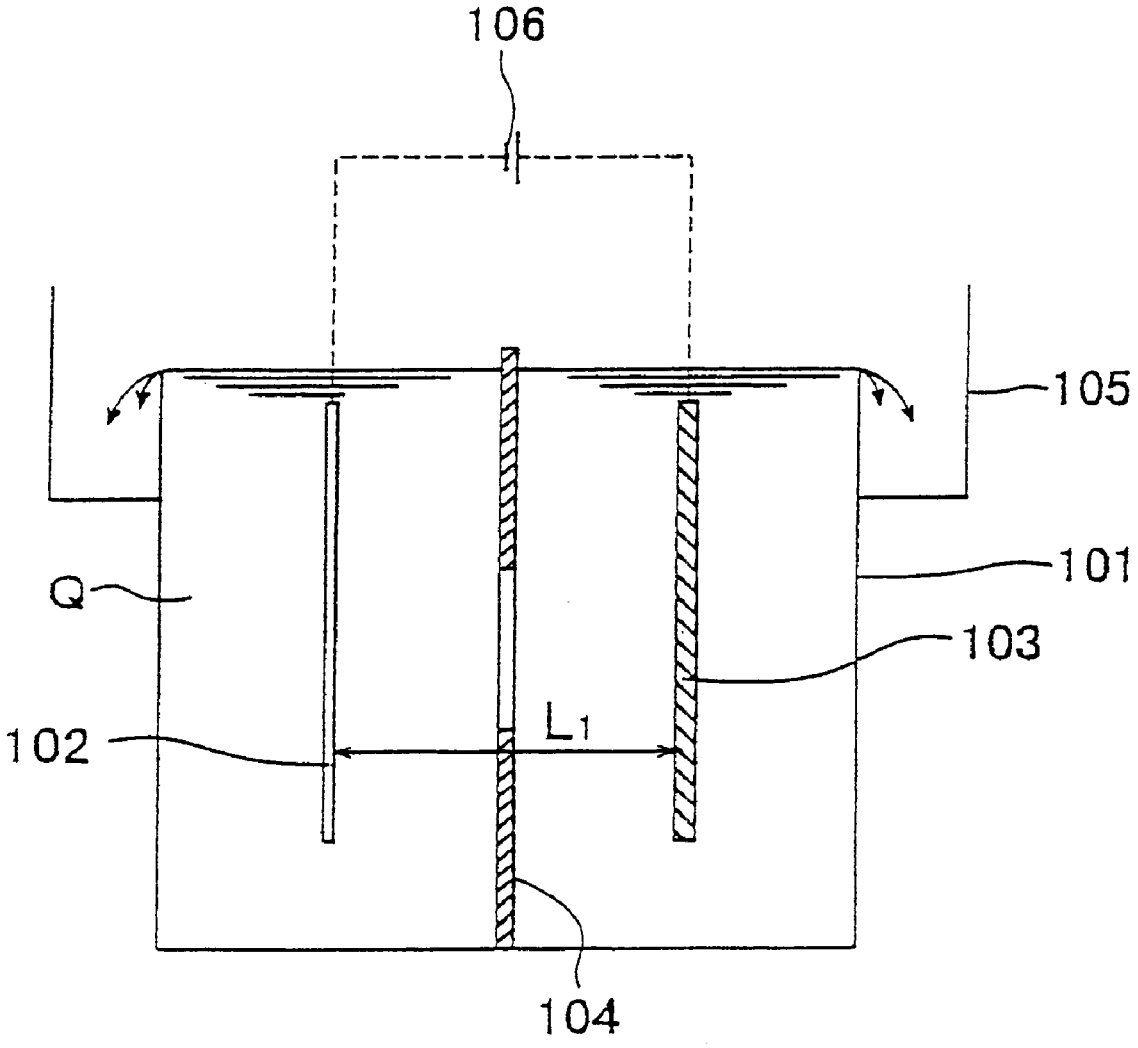
FIG. 1 shows the general construction of a conventional substrate plating apparatus.
Figure 2:
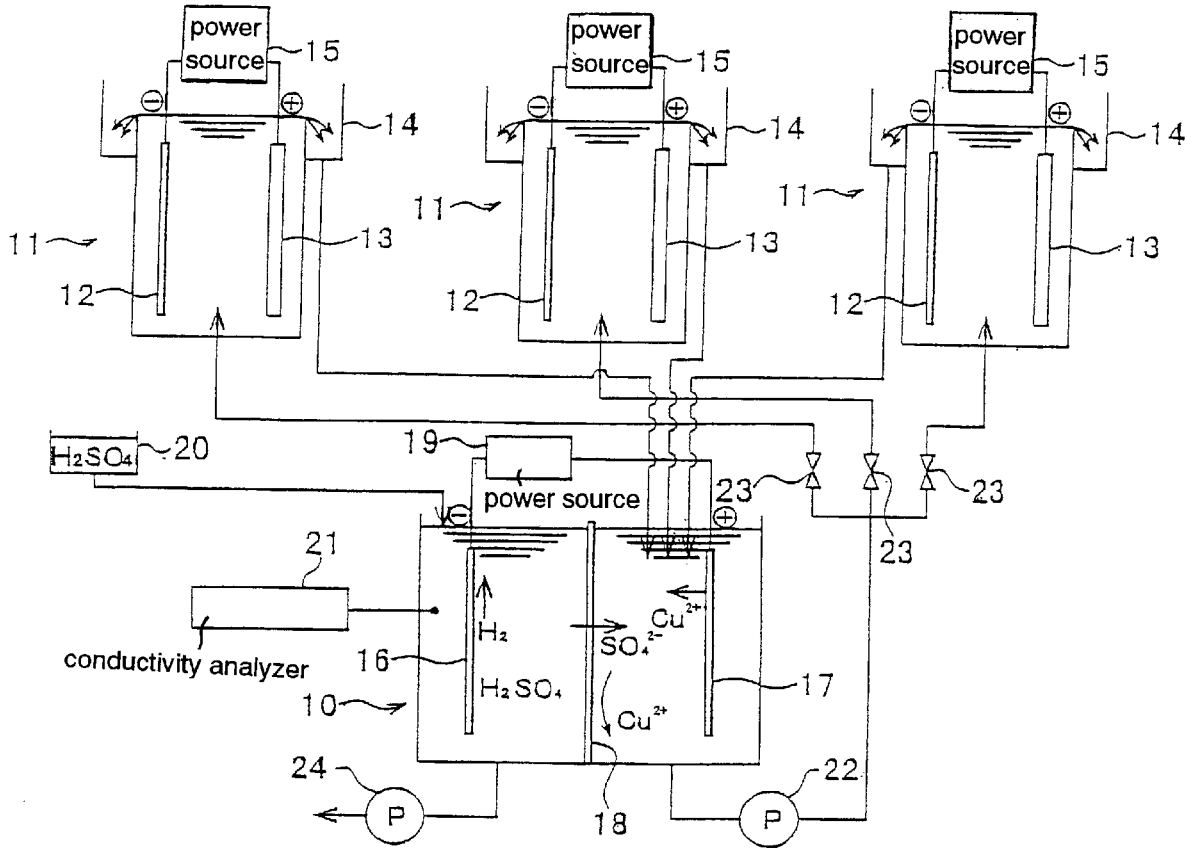
FIG. 2 shows a first embodiment of a substrate plating apparatus according to the present invention.

FIG. 2 shows an embodiment of a substrate plating apparatus according to a first embodiment of the present invention. The substrate plating apparatus includes a circulating vessel or dummy vessel 10 and a plurality (three in this embodiment) of plating baths 11. Each plating bath 11 contains a semiconductor wafer 12 that is the object of a copper plating process; an insoluble anode 13 disposed opposite the semiconductor wafer 12; and a power source 15 connected between the semiconductor wafer 12 and the anode 13.

The circulating vessel or dummy vessel 10 contains a dummy cathode 16; a soluble anode 17 formed of copper and disposed opposite the cathode 16; and an anion exchange film 18 disposed between the cathode 16 and anode 17 for dividing the circulating vessel or dummy vessel 10 into a dummy cathode side and an anode side. A DC power source 19 is connected between the cathode 16 and anode 17. A conductivity analyzer 21 is provided on the circulating vessel or dummy vessel 10 to measure the conductivity of the liquid contained within the circulating vessel or dummy vessel 10. Sulfuric acid ($H_2SO_4$) is supplied from a sulfuric acid source 20 to maintain the liquid at a uniform conductivity.

By applying a DC voltage of a predetermined amount from the power source 19, the anode 17 emits $Cu^{2+}$ ions into the liquid on the anode side, while on the cathode side $SO_4^{2-}$ negative ions and $H_2$ gas are generated. The $H_2$ gas escapes from the top of the vessel. The $SO_4^{2-}$ ions pass through the anion exchange film 18 and are supplied to the anode side, while the $Cu^{2+}$ ions do not pass through the anion exchange film 18. A pump 22 pumps out the aqueous solution containing a mixture of $Cu^{2+}$ and $SO_4^{2-}$ ions. This solution is supplied as the plating solution to each of the plating baths 11 via a plurality of on-off valves 23.

A collecting gutter 14 is provided on each of the plating baths 11 to collect excess plating solution that overflows from the plating baths 11. This excess liquid collected by the collecting gutter 14 is returned to the anode side of the circulating vessel or dummy vessel 10. At this time, the anode 17 replenishes the liquid with $Cu^{2+}$ ions and the liquid is subsequently resupplied to each of the plating baths 11. In other words, the plating solution is supplied with $Cu^{2+}$ ions to compensate for the amount consumed in the copper plating process conducted in each of the plating baths 11.

In the plating apparatus described above, the sum of currents $I_1$, $I_2$, and $I_3$ flowing between the semiconductor wafer 12 and anode 13 of each respective plating bath 11 is set equal to a current I flowing between the cathode 16 and anode 17 in the circulating vessel or dummy vessel 10 ($I=I_1+I_2+I_3$). As a result, it is possible to supply to each of the plating baths 11 an amount of $Cu^{2+}$ ions corresponding to the amount consumed in the plating process. In addition, there is no longer a need to replace the anodes in the plating baths 11 regularly or to perform bothersome measures or operations associated with the prior art to prevent contamination generated by black film on the surface of the anodes. Also in FIG. 2, a pump 24 is provided for discharging liquid from the circulating vessel or dummy vessel 10.

Figure 3:
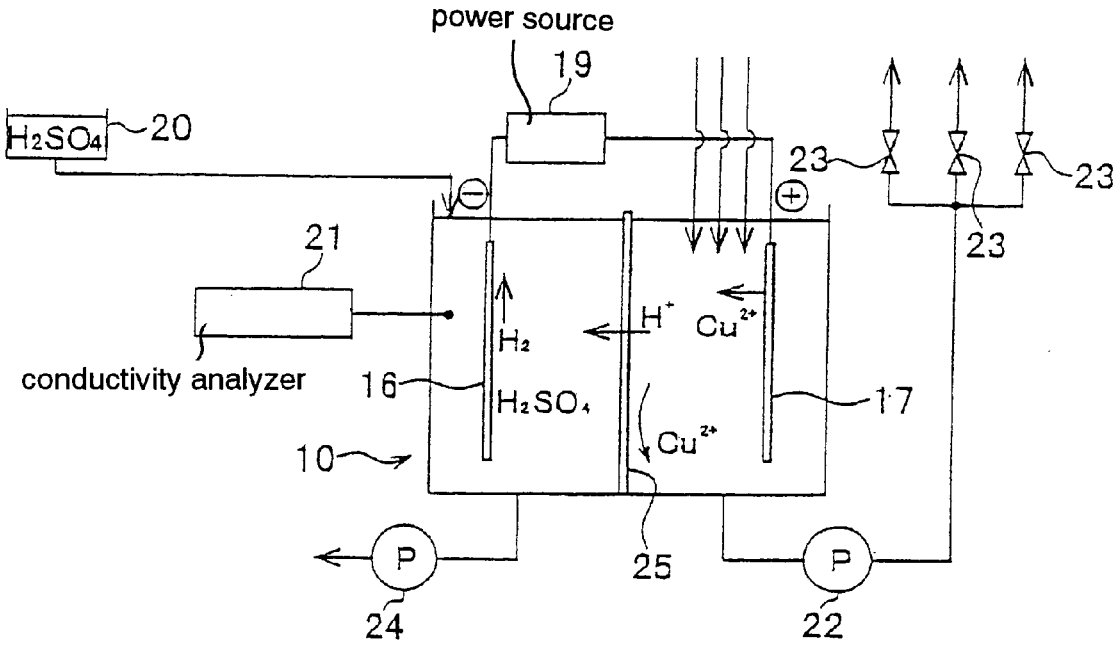
FIG. 3 shows another embodiment of a circulating vessel or dummy vessel used in the substrate plating apparatus.

FIG. 3 shows another embodiment of a construction of the circulating vessel or dummy vessel 10 employed in the substrate plating apparatus of the present invention. The embodiment in FIG. 3 differs from that in FIG. 2 only in that the anion exchange film 18 provided between the cathode 16 and anode 17 is replaced with a selective cation exchange film 25. The cation exchange film 25 allows the passage of $H^+$ ions, but prevents the passage of $Cu^{2+}$ ions.

With this configuration, the power source 19 applies a direct current of a predetermined value between the cathode 16 and anode 17 and the pump 22 supplies a plating solution containing $Cu^{2+}$ ions emitted from the anode 17 to each of the plating baths 11 shown in FIG. 2 via the plurality of on-off valves 23. Plating liquid overflowing from each of the plating baths 11 is returned to the anode side of the circulating vessel or dummy vessel 10, as described for FIG. 2.

Figure 4:
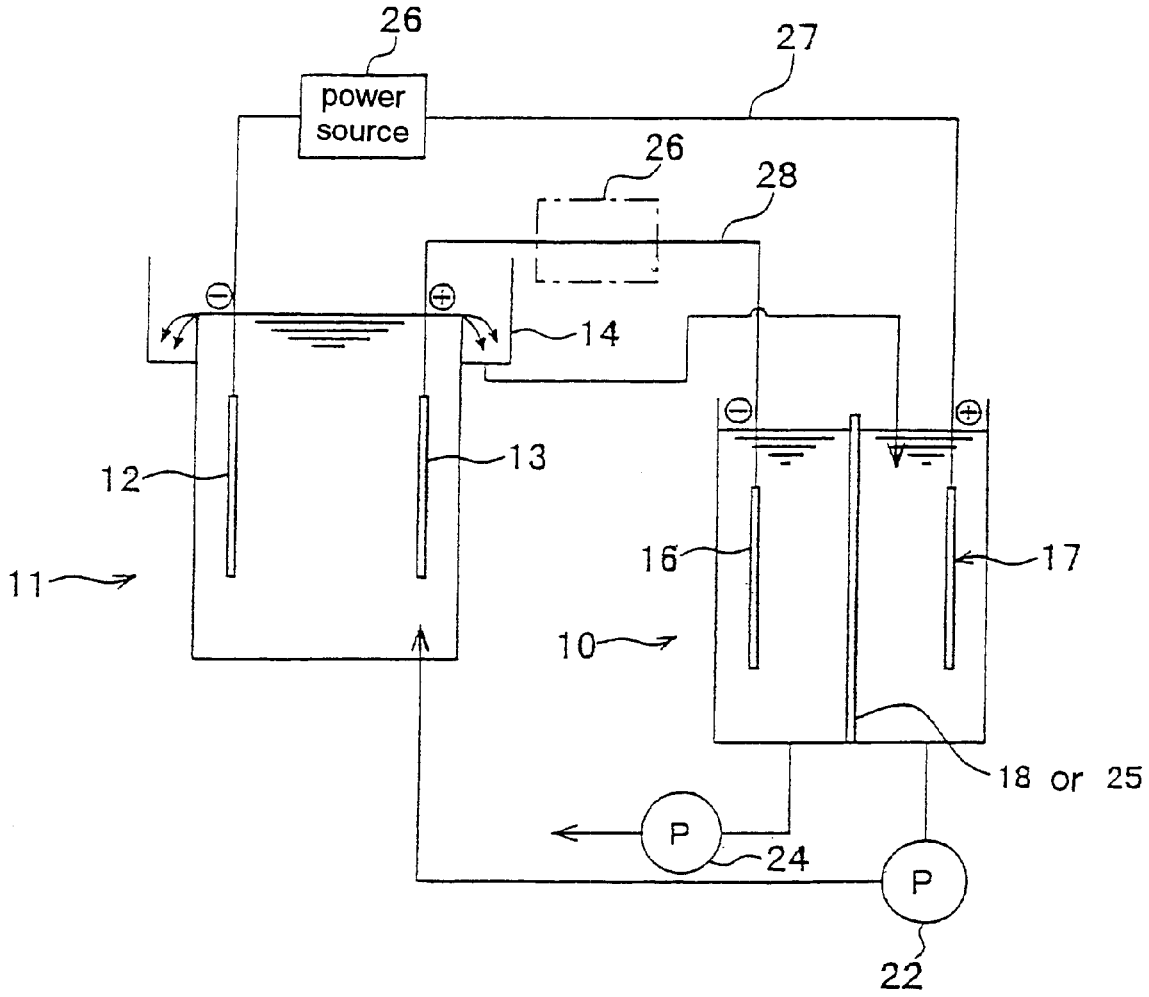
FIG. 4 shows another embodiment of the substrate plating apparatus according to the present invention.

FIG. 4 shows another embodiment of a substrate plating apparatus according to the present invention. In this substrate plating apparatus, one circulating vessel or dummy vessel 10 is provided for each plating bath 11. Liquid in the anode side of the circulating vessel or dummy vessel 10 as divided by the anion exchange film 18 or cation exchange film 25 is supplied to the plating baths 11, while plating solution overflowing from the plating baths 11 is returned to the anode side of the circulating vessel or dummy vessel 10.

The semiconductor wafer 12, serving as the cathode in the plating baths 11, is connected to the anode 17 in the circulating vessel or dummy vessel 10, while the anode 13 is connected to the cathode 16. Connecting wires 27 and 28 are provided to connect the semiconductor wafer 12 and anode 17 and the insoluble anode 13 and cathode 16, respectively. A power source 26 is connected in the middle of either the connecting wire 27 or the connecting wire 28.

With a substrate plating apparatus as described above, the current flowing between the cathode 16 and anode 17 is the same as the current I flowing between the semiconductor wafer 12 and anode 13. Accordingly, an amount of $Cu^{2+}$ ions equivalent to the amount consumed in the plating baths 11 is supplied from the circulating vessel or dummy vessel 10.

In the substrate plating apparatus shown in FIGS. 2–4, the liquid contact area of the selective ion exchange film disposed between the cathode 16 and anode 17 must of course be adjusted based on the type of ions used. As described on page 5 of the *Plating Manual* (Mekki Kyohon) by the Electroplating Society (Nikkan Kogyo Shinbun, Ltd.), the speed of ions in liquid differs as shown below, depending on whether the ions are $H^+$, $Cu^{2+}$, or $SO_4^{2-}$.

Moving Speed of Ions in Aqueous Solution at 18° C.

| | | |
|---|---|---|
| Cation selective exchange film | $H^+$ | 31.5 μm/s |
| | $Cu^{2+}$ | 2.9 μm/s |
| Anion selective exchange film | $SO_4^{2-}$ | 5.93 μm/s |

The moving speeds indicated above were measured by applying a voltage of 1 V between electrodes spaced 1 centimeter apart.

In the embodiment described above, the soluble anode 17 is formed of copper and generates $Cu^{2+}$ ions, and a copper plating process is conducted on the semiconductor wafer 12. However, the present invention is not limited to conducting copper plating in the plating baths 11, but can be applied to other types of metal plating. When performing a different type of metal plating, the soluble anode 17 should be a metal anode that emits positive metallic ions corresponding to the type of metal plating to be performed.

Further, the substrate in the present embodiment is not limited to a semiconductor wafer, but can apply to any substrate capable of being plated.

A substrate plating apparatus according to the first embodiment of the present invention has the following remarkable advantages.

By replenishing the plating bath with metallic ions generated from the soluble anode in the circulating vessel or dummy vessel provided separately from the plating supply vessel, not only is it possible to automatically supply metallic ions, but it is no longer necessary to replace the anode in the plating supply vessel regularly or take measures against black film on the surface of the anode.

By making the current flowing between the anode and cathode in the circulating vessel or dummy vessel equal to the total current flowing between substrates and insoluble anodes in the plating baths, maintenance need only be conducted on the soluble anode in one circulating vessel or dummy vessel.

Further, by making the current flowing between the anode and cathode of the circulating vessel or dummy vessel equal to the current flowing between the anode and cathode of the plating bath, it is possible to supply an amount of metallic ions equal to the amount consumed in the plating bath.

Figure 5:
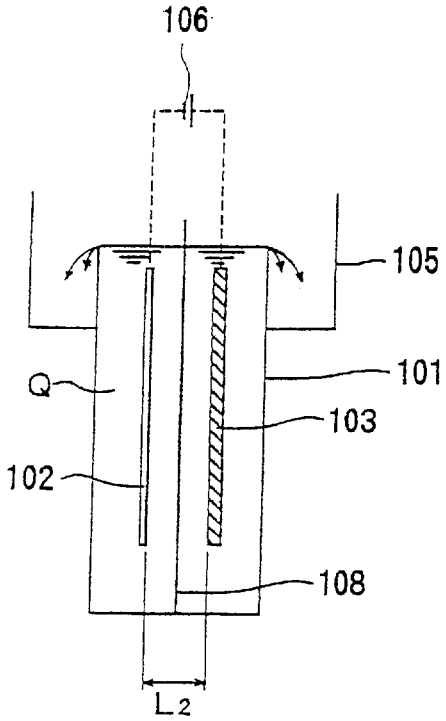
FIG. 5 shows a second embodiment of the substrate plating apparatus according to the present invention.

FIG. 5 shows a partial view of a substrate plating apparatus according to a second embodiment of the present invention. As shown in the diagram, the substrate plating apparatus includes a positive ion exchange film 108 disposed between the substrate 102 (cathode) and anode 103.

As described above, a uniform distribution of the primary current should be provided between the substrate 102 and anode 103 to improve uniformity of the plating thickness on the surface of the substrate 102. In order to attain a uniform primary current distribution, the distance between the substrate 102 and the anode 103 should be large. However, in order to increase the distance between the substrate 102 and anode 103, the substrate plating vessel 101 must also be large. Here, disposing the positive ion exchange film 108 between the substrate 102 and anode 103 is equivalent to increasing the distance between the substrate 102 and anode 103. The positive ion exchange film 108 divides the substrate plating vessel 101 into two regions, that is, the region near the substrate 102 and the region near the anode 103.

With regard to the distance between the substrate 102 and anode 103 in the apparatus shown in FIG. 5 at $L_2$ and the distance between the substrate 102 and anode 103 in the apparatus of the prior art, which is not provided with a positive ion exchange film 108, at $L_1$, the following relationship is true even when attaining a uniform distribution of the same primary current.

$$L_1 >> L_2$$

In other words, the interval $L_2$ between the substrate 102 and anode 103 in the present invention can be made smaller than the interval $L_1$ in the prior art to obtain a uniform primary current distribution.

Figure 6:
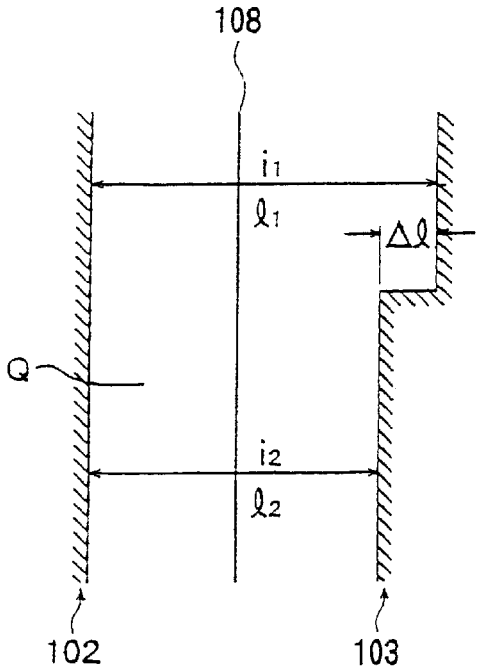
FIG. 6 is an explanatory diagram showing the effects of disposing a positive ion exchange film or neutral porous diaphragm between the cathode and anode in the substrate plating apparatus.

FIG. 6 shows the effects of disposing a positive ion exchange film 108 between the substrate 102 and anode 103. As shown in the diagram, a step is incorporated in the surface of the anode 103. Assuming that the current density at the interval $L_1$ between the substrate 102 and anode 103 is $I_1$, the current density at the interval $L_2$ is $I_2$, the resistance of the plating solution Q is ρ, and the transmission resistance is R, then:

$$i_2/i_1 = (1_1\rho + R)/(1_2\rho + R)$$

$$= \{1_2 + \Delta I)\rho + R\}/1_2\rho + R)$$

$$= 1 + (\Delta I\rho)/(1_2\rho + R)$$

Hence, to achieve a uniform primary current distribution, the current density $i_2/i_1$ should approach

1.Rather than increasing the distance $l_2$ between the substrate 102 and anode 103 for this fraction to approach 1, the positive ion exchange film 108 is disposed between the substrate 102 and anode 103 to provide electrical resistance in the plating solution. This achieves the same effects. In other words, positioning the ion exchange film 108 between the substrate 102 and anode 103 has the same effects as increasing the distance between the substrate 102 and anode 103, even when the distance is not great. This in turn enables the construction of a small substrate plating apparatus.

When the substrate plating apparatus shown in FIG. 5 is a copper plating apparatus for forming a copper plating film on the substrate 102, the anode 103 is a soluble anode, and the plating solution is copper sulfate, if the cation exchange film 108 only allows the passage of $Cu^{2+}$ ions dissolved from the anode 103, then the ion exchange film 108 can block impurities dissolved from the anode 103, drastically reducing the number of particles in the liquid near the region of the substrate 102.

While the invention described above employs an ion exchange film 108 between the substrate 102 and anode 103, a neutral porous diaphragm employing a fine particle removing function can be used in place of the ion exchange film 108 with the same effects.

The ion exchange film described above can be a commercial product having the capability of selectively filtering ions according to their electrical property. One such example is "Ceremion" produced by the Asahi Glass Company. The neutral porous diaphragm is a porous film formed of synthetic resin and having extremely small holes of uniform diameter. One such example is a product called "YUMICRON" manufactured by Yuasa Ionics, which has an aggregate of polyester and a film material formed of polyvinylidene fluoride and titanium oxide.

Figure 7:
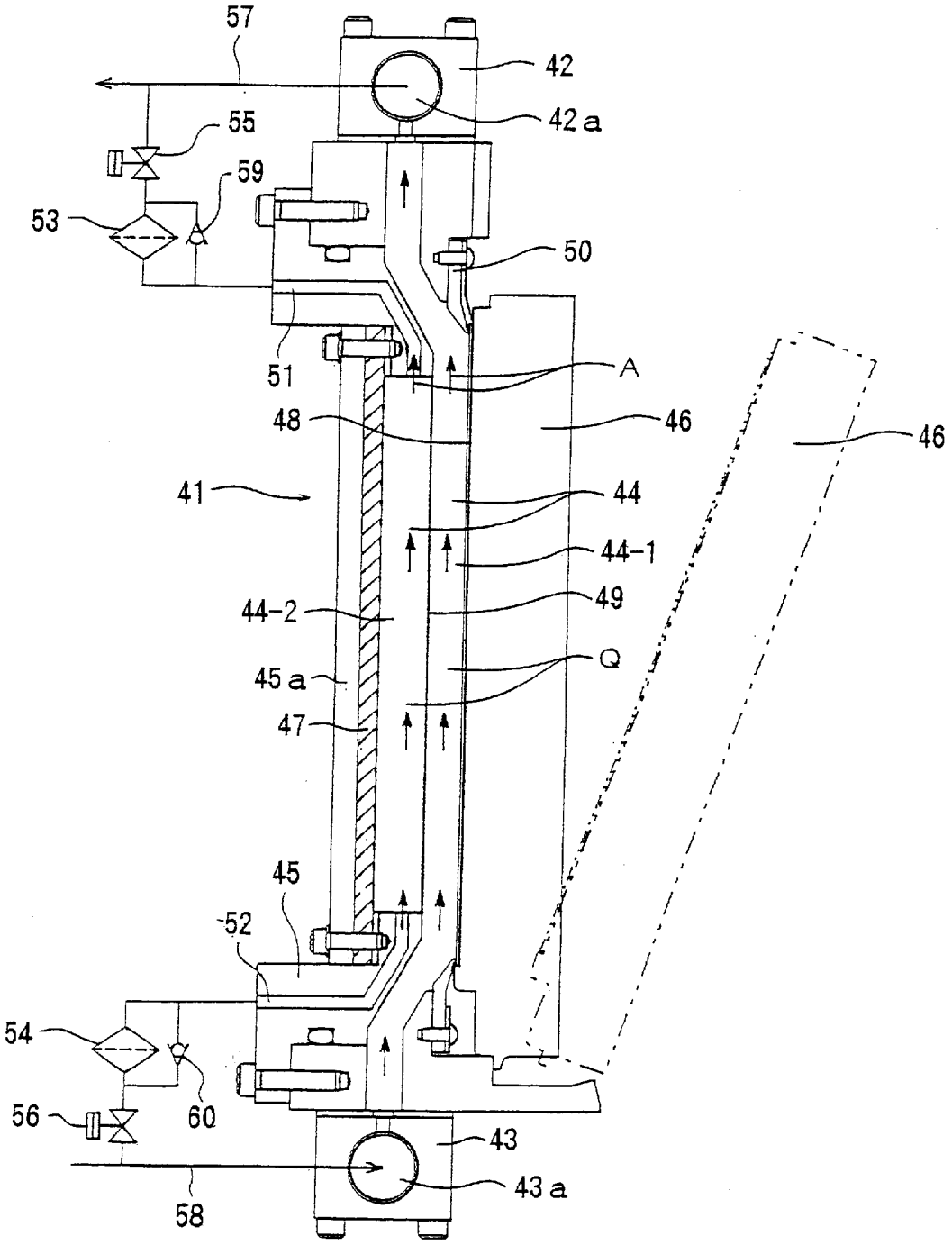
FIG. 7 is a cross-sectional view showing a detailed structure of a substrate plating apparatus according to the second embodiment of the present invention.

FIG. 7 is a cross-sectional view showing the basic construction of a plating bath used in the substrate plating apparatus of the present invention. As shown in the diagram, a plating bath 41 includes a main section 45 and a side plate 46. A depression 44 is formed in the main section 45 for accommodating plating solution. A hinge mechanism (not shown) is provided on the lower end of the side plate 46 to enable the opening and closing of the opening to the depression 44. A soluble anode 47 is disposed on the surface of a bottom plate 45*a* of the main section 45 on the side plate 46 side. A substrate 48, such as a semiconductor wafer, for plating is mounted on the main section 45 side surface of the side plate 46. A packing 50 contacts the surface of the substrate 48 when the side plate 46 is closed over the opening of the depression 44. The depression 44 is hermetically sealed.

An ion exchange film or neutral porous diaphragm 49 is disposed between the substrate 48 and anode 47 when the side plate 46 is closed over the depression 44, thereby dividing the depression 44 into a substrate region 44-1 and an anode region 44-2. An upper header 42 and a lower header 43 are provided on the top and bottom of the main section 45, respectively. An opening 42*a* in the upper header 42 and an opening 43*a* in the lower header 43 are in liquid communication with the substrate region 44-1.

A plating solution inlet 51 and outlet 52 are formed in liquid communication with the top and bottom of the anode region 44-2, respectively. Shutoff valves 55 and 56 are disposed at the ends of the inlet 51 and outlet 52 via filters 53 and 54. The shutoff valves 55 and 56 are connected to the openings 42*a* and 43*a* via pipes 57 and 58 respectively. Hence, plating solution entering the substrate region 44-1 and anode region 44-2 in the main section 45 is separated externally from the main section 45 before being introduced therein. After exiting the main section 45, the plating solution is recombined outside the main section 45. Further, plating solution entering and exiting the anode region 44-2 must pass through the filters 53 and 54. The apparatus shown in FIG. 7 also includes reverse stop valves 59 and 60.

In the plating bath 41 described above, a plating solution Q in the pipe 58 is supplied via the opening 43*a* to the substrate region 44-1 and via the shutoff valve 56 and filter 54 to the anode region 44-2. Accordingly, the plating solution Q flows in the direction indicated by the arrows A through the substrate region 44-1 and anode region 44-2. The plating solution Q in the substrate region 44-1 passes through the opening 42*a* and flows out into the pipe 57. The plating solution Q in the anode region 44-2 flows through the inlet 51, the filter 53, and the shutoff valve 55 and merges with the plating solution Q from the substrate region 44-1 flowing in the pipe 57.

In the substrate plating apparatus described above, black film deposited on the surface of the anode 47 produces particles in the plating solution Q in the anode region 44-2. However, these particles are prevented from being combined with the plating solution Q in the substrate region 44-1 because the plating solution Q flowing out of the anode region 44-2 passes through the filter 53 and shutoff valve 55 before combining outside of the main section 45 with plating solution Q flowing out of the substrate region 44-1.

Before removing the substrate 48 from the plating bath 41, the plating solution Q is discharged from the substrate region 44-1. The plating solution Q in the anode region 44-2 should not be discharged in order to prevent the black film on the surface of the anode 47 from converting into white film. Therefore, when removing the substrate 48 from the plating bath 41, the shutoff valve 55 and shutoff valve 56 can be closed to prevent the discharge of plating solution Q from the anode region 44-2.

In the embodiment described above, plating solution Q flows in the substrate region 44-1 and anode region 44-2 from the bottom of the main section 45 to the top. However, it is also possible to configure the main section 45 such that the plating solution Q flows from the top to the bottom or alternates directions from the top to the bottom and the bottom to the top. Furthermore, a predetermined voltage is applied between the substrate 48 and anode 47.

As described above, the ion exchange film or neutral porous diaphragm 49 is disposed between the substrate 48 and anode 47 to achieve the equivalent effect of increasing electrical resistance in the plating solution Q between the substrate 48 and anode 47. Hence, even if the distance between the substrate 48 and anode 47 is small it is still possible to achieve a uniform primary current distribution between the substrate 48 and anode 47, thereby forming a plating film of uniform thickness on the surface of the substrate 48.

If the anode 47 is a soluble electrode, such as a copper plate, and the plating solution Q is copper sulfate solution, then the cation exchange film or neutral porous diaphragm 49 allows only the passage of copper ions dissolved from the anode 47. As a result, the cation exchange film or neutral porous diaphragm 49 can block impurities dissolved from the anode 47 and drastically reduce the amount of particles in the plating solution Q on the side of the substrate 48.

Figure 8:
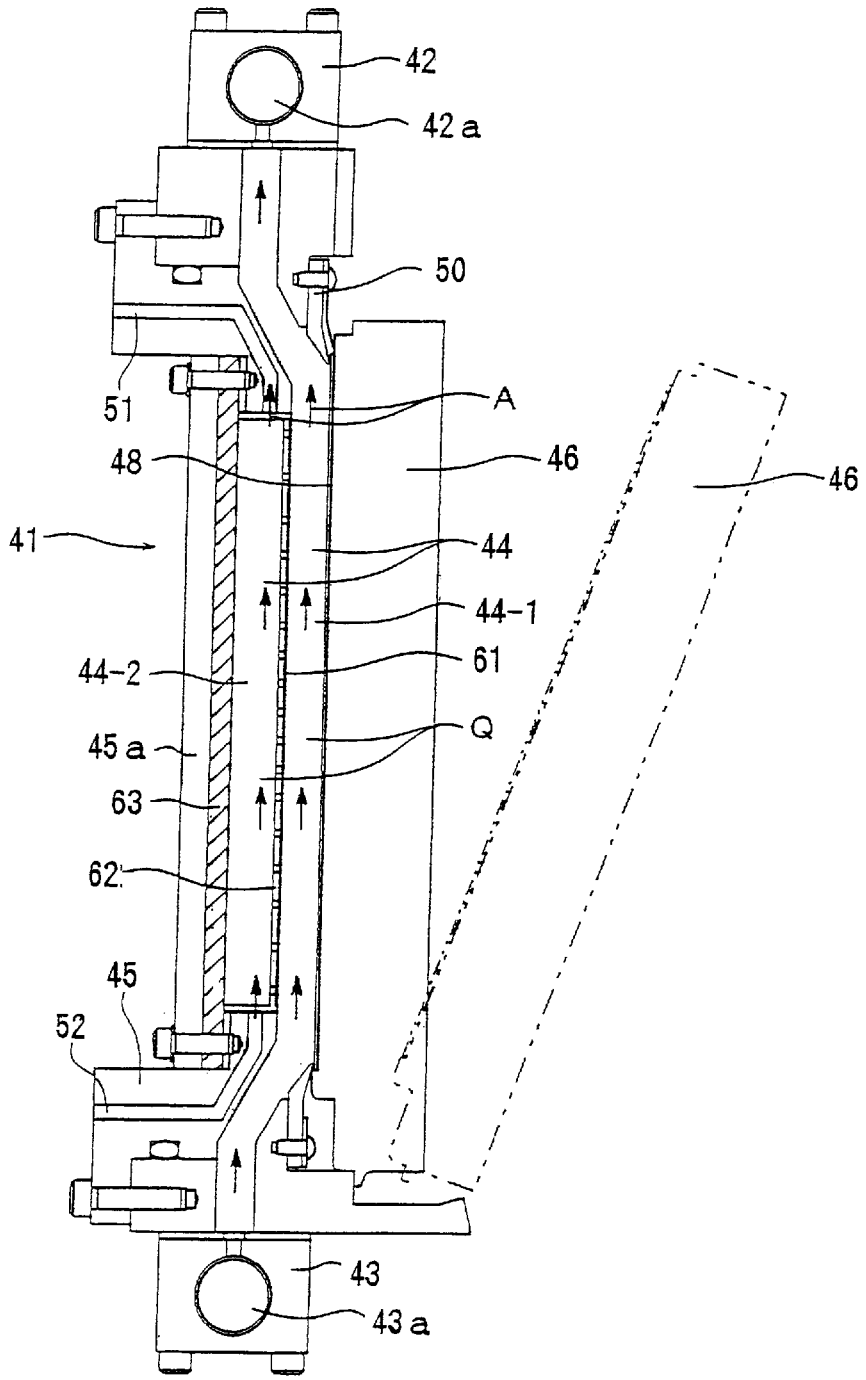
FIG. 8 is a cross-section view showing another embodiment of the detailed structure of the substrate plating apparatus.

FIG. 8 is a cross-sectional view showing another detailed structure of the plating bath for a substrate plating apparatus of the present invention. The plating bath 41 of FIG. 8 differs from that in FIG. 7 on the following points. An insoluble anode 63 is used in place of the soluble anode 47, while a diaphragm 61 formed of a neutral porous diaphragm or an ion exchange film is disposed between the anode 63 and substrate 48 to divide the plating bath 41 into the substrate region 44-1 and the anode region 44-2. Further, a plate 62 is provided in contact with the diaghram 61 and serves as a current shielding plate for generating a uniform primary current distribution between the anode 63 and substrate 48.

Although not shown in the diagrams, the plating bath 41 is provided with separate circulating pumps for separately circulating plating solution in the substrate region 44-1 and in the anode region 44-2.

As described above, a diaphragm 61 formed of a neutral porous diaphragm or ion exchange film is disposed between the anode 63 and substrate 48. Since the fresh plating solution does not contact the surface of the anode 63, the additives are not resolved. As a result, the life of the plating solution Q can be lengthened.

By circulating the plating solution in the substrate region 44-1 and anode region 44-2 using separate circulating pumps, plating solution flowing through the anode region 44-2 flows separately from plating solution flowing over the surface of the substrate 48 and flows out of the main section 45 together with $O_2$ gas produced from the surface of the anode 63.

Next, the remarkable advantages of the substrate plating apparatus according to the present invention will be described.

Providing an ion exchange film or neutral porous diaphragm between the substrate and the anode has an equivalent effect to increase the electrical resistance in the plating solution between the substrate and the anode. Accordingly, it is possible to achieve a uniform primary current distribution between the substrate and the anode, even if the distance between the two is small, thereby forming a uniform plating film on the surface of the substrate. As a result, manufacturers can attempt to decrease the size of the substrate plating apparatus.

By using a soluble anode and an ion exchange film that only allows the passage of ions dissolved from the soluble anode, the ion exchange film can block impurities dissolved from the anode. Accordingly, the configuration can drastically reduce the amount of particles in the plating solution on the side of the substrate.

Further the substrate plating apparatus described above is provided with shutoff valves at the inlet and outlet to the anode region, such that plating solution in the anode region passes through the shutoff valve before combining with plating solution flowing out of the substrate region. In other words, plating solution in the anode region and substrate region are combined outside the plating bath. Accordingly, particles emitted from black film deposited on the anode are not combined with plating solution in the substrate region.

Further, a filter provided on the outlet to the anode region removes particles generated in the plating solution from black film deposited on the anode.

Further, a diaphragm formed of a neutral porous diaphragm or ion exchange film is disposed between the anode and substrate. Accordingly, fresh plating solution does not contact the surface of the anode. As a result, resolved additives are not introduced into the substrate region, thereby lengthening the life of the plating solution.

By circulating plating solution in the substrate region and the anode region using separate circulating devices, the plating solution flowing in the anode region flows separately from that plating solution flowing in the substrate region and discharges externally along with $O_2$ gas produced from the surface of the anode.

Figure 9:
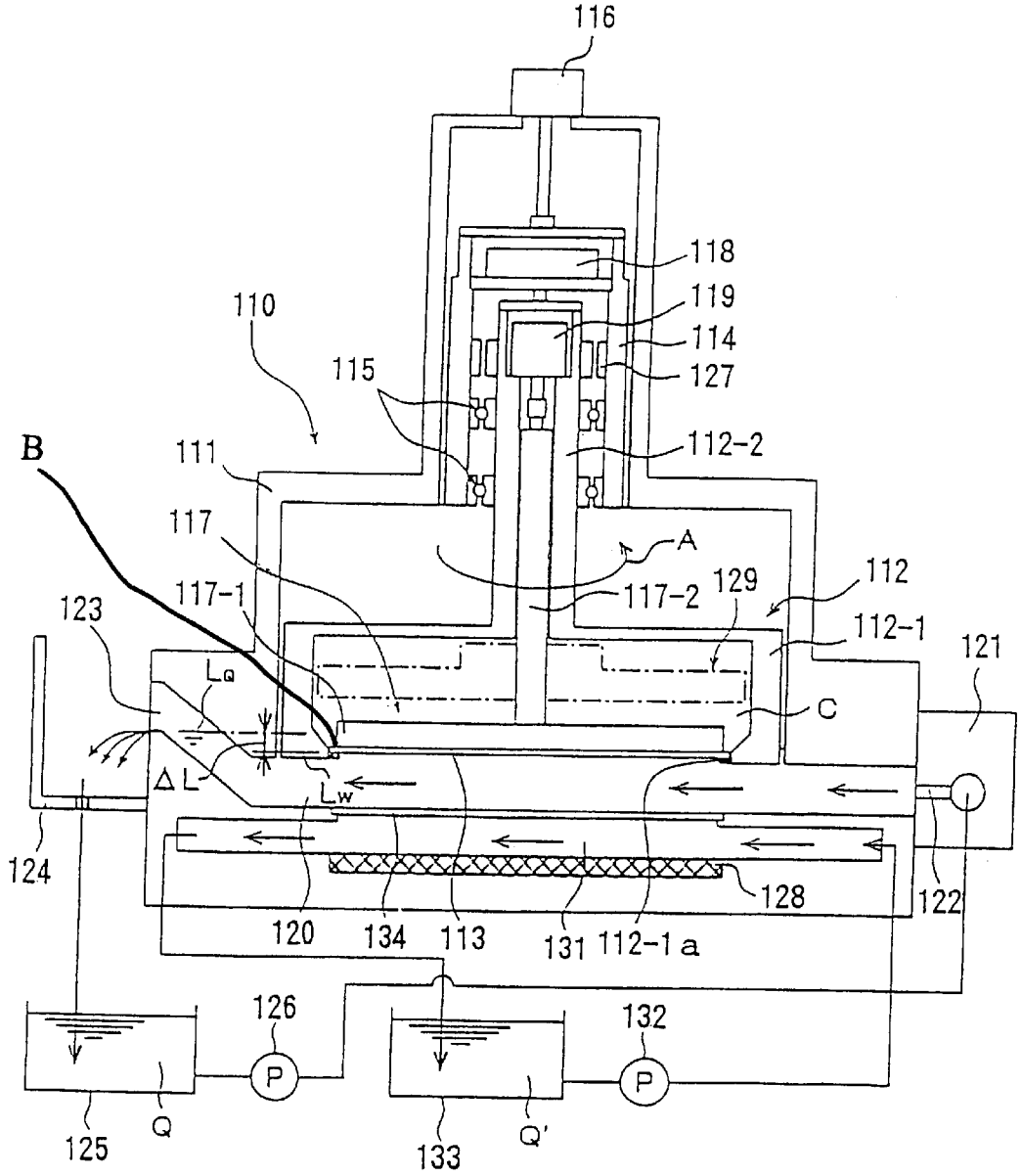
FIG. 9 shows a third embodiment of a substrate plating apparatus according to the present invention.

FIG. 9 shows a third embodiment of the substrate plating apparatus according to the present invention. As shown in the diagram, a plating bath 110 contains a main section 111. The main section 111 accommodates a plating retainer 112 for supporting a substrate 113 such as a semiconductor wafer. The plating retainer 112 comprises a retaining member 112-1 and a shaft member 112-2. The shaft member 112-2 is rotatably supported on the inner walls of a cylindrical guide member 114 via bearings 115. The guide member 114 and plating retainer 112 can be raised and lowered at a predetermined stroke by a cylinder 116 provided at the top of the main section 111.

A motor 118 is provided at the inner top of the guide member 114 for rotating the plating retainer 112 in the direction indicated by the arrow A via the shaft member 112-2. A space C formed in the plating retainer 112 contains a substrate presser 117. The presser 117 comprises a pressing member 117-1 and a shaft member 117-2. A cylinder 119 is provided at the inner top of the shaft member 112-2 for moving the presser 117 up and down at a predetermined stroke.

Figure 10:
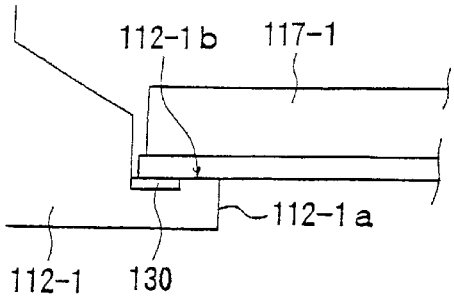
FIG. 10 is an enlarged view of the area B in FIG. 9.

An opening 112-1*a* is provided at the bottom of the retaining member 112-1 and is in liquid communication with the space C. A step 112-1*b* as shown in FIG. 10 is formed at the top of the opening 112-1*a* for supporting the edge of the substrate 113. By supporting the edge of the substrate 113 on the step 112-1*b* and applying pressure to the top surface of the substrate 113 with the pressing member 117-1, the edge of the substrate 113 is pinched by the pressing member 117-1 and the step 112-1*b*. The bottom surface (plating surface of the substrate 113) is exposed in the opening 112-1*a*.

A plating solution chamber 120 is provided beneath the retaining member 112-1 for enabling the flow of plating solution Q beneath the plating surface of the substrate 113 exposed in the opening 112-1*a*. A plating solution supply header 121 is disposed on one side of the main section 111. A plating solution inlet 122 is formed in the plating solution supply header 121 and is in liquid communication with the plating solution chamber 120. A plating solution outlet 123 is formed in the opposite side of the main section 111 from the plating solution supply header 121 to enable the outflow of the plating solution Q. A collecting gutter 124 is provided around the outside of the main section 111 for collecting plating solution Q flowing out of the outlet 123 (overflowing from the plating solution chamber 120).

The plating solution Q collected by the collecting gutter 124 is returned to a plating solution tank 125. A pump 126 is provided to supply plating solution Q in the plating solution tank 125 to the plating solution supply header 121. The plating solution Q supplied to the plating solution supply header 121 flows into the plating solution chamber 120 from the inlet 122, flows horizontally along and in contact with the plating surface of the substrate 113, then flows out into the collecting gutter 124 via the outlet 123. In other words, the plating solution Q is cycled between the plating solution chamber 120 and plating solution tank 125.

The level of the plating solution surface $L_Q$ shown in the diagram is only slightly higher by a small $\Delta L$ than the level $L_W$ at the substrate 113 in order that the entire plating surface of the substrate 113 is contacted by plating solution Q. The inlet 122 and outlet 123 are disposed one on either side of the substrate 113 and outside the periphery of the substrate 113. The plating solution Q in the plating solution chamber 120 flows horizontally while contacting the plating surface of the substrate 113. As shown in FIG. 10, an electrical contact 130 is provided for electrically connecting the conducting portion of the substrate 113 on the step 112-1*b*. The electrical contact 130 is connected via a brush 127 to the cathode of a power source (not shown) outside of the main section 111. An anode 128 is provided opposite the substrate 113 below the plating solution chamber 120. The anode 128 is connected to the anode of the power source. A slit 129 is formed at a predetermined position in the wall of the main section 111 to facilitate insertion and removal of the substrate 113 using a substrate transport jig such as a robot arm.

An ion exchange film or neutral porous diaphragm 134 is disposed on the bottom of the plating solution chamber 120. An anode chamber 131 is disposed beneath the ion exchange film or neutral porous diaphragm 134. The anode 128 is provided on the bottom of the anode chamber 131. Plating liquid or conductive liquid Q' is introduced from the anode chamber 131 into the plating solution chamber 120 via the ion exchange film or neutral porous diaphragm 134. A liquid tank 133 contains the plating solution or conductive liquid Q' and a pump 132 supplies the plating solution or conductive liquid Q' in the liquid tank 133 to the anode chamber 131. After flowing through the anode chamber 131 the plating solution or conductive liquid Q' is recycled to the liquid tank 133. In other words, plating solution or conductive liquid Q' is cycled between the anode chamber 131 and liquid tank 133.

Next, the plating operations will be described for a plating apparatus having the construction described above. First, the cylinder 116 is activated, moving the plating retainer 112 and guide member 114 upward a predetermined amount (to a position in which the substrate 113 supported by the retaining member 112-1 corresponds to the slit 129). At the same time, the cylinder 119 is activated to move the presser 117 up a predetermined amount (such that the pressing member 117-1 contacts the top of the slit 129). At this time, a robot arm or other substrate transporting jig inserts a substrate 113 into the space C of the plating retainer 112. The substrate 113 is placed on the step 112-1*b* with its plating surface facing downward. The cylinder 119 is again driven to move the presser 117 until the bottom of the surface of the pressing member 117-1 contacts the top surface of the substrate 113, effectively pinching the edge of the substrate 113 between the pressing member 117-1 and the step 112-1*b*.

At this time, the cylinder 116 is operated to move the plating retainer 112 and guide member 114 downward until the plating surface of the substrate 113 contacts the plating solution flowing through the plating solution chamber 120 (or until the bottom surface of the substrate 113 is just ΔL lower than the lever of the plating solution surface $L_Q$). Next, the motor 118 is driven to move the plating retainer 112 and substrate 113 downward while rotating them at a slow speed. As described above, plating solution Q is supplied from the plating solution tank 125 to the plating solution chamber 120 by means of the pump 126 and circulated in this manner. During this time, the power source applies a predetermined voltage between the anode 128 and electrical contact 130 to create a plating current from the anode 128 to the substrate 113 and form a plating film on the plating surface of the substrate 113.

During the plating process, the motor 118 drives the plating retainer 112 and substrate 113 to rotate at the low speed of 1–10 rpm. By rotating the substrate 113 at this low rotational speed, it is possible to avoid causing adverse effects to the flow of the plating solution Q in the plating solution chamber 120 (level to the plating surface of the substrate 113), that is, to avoid disturbing the uniform relative speed between the plating surface and plating solution. The rotation also eliminates differences in film thickness generated on the upstream and downstream sides of the flow of plating solution to form a plating film of uniform thickness on the plating surface of the substrate 113.

When the plating process is completed, the cylinder 116 is driven to move the plating retainer 112 and substrate 113 upward until the bottom surface of the retaining member 112-1 is above the plating solution level $L_Q$. At this point, the motor 118 spins the plating retainer 112 and substrate 113 at a high speed to shake off plating solution deposited on the plating surface of the substrate and bottom surface of the retaining member 112-1 using centrifugal force. After shaking off the plating solution, the substrate 113 is raised until positioned at the slit 129. Next, the cylinder 119 is operated to raise the pressing member 117-1, releasing the substrate 113 such that the substrate 113 rests on the step 112-1*b*. Here, the robot arm or other substrate transport jig is inserted in the space C of the plating retainer 112, and picks up and removes the substrate 113 from the slit 129.

As described above, the anode chamber 131 is disposed beneath the inlet 122 and separated from the same by the ion exchange film or neutral porous diaphragm 134. Plating liquid or conductive liquid Q' is flowed through the anode chamber 131. With this configuration, it is possible to prevent resolution of additives from oxidizing on the surface of the anode 128 when using an insoluble anode 128. Further, oxide gas generated from the surface of the anode 128 is blocked by the ion exchange film or neutral porous diaphragm 134 and prevented from reaching the plating surface of the substrate 113. Accordingly, this construction can prevent unusual consumption of additives in the plating solution Q, as well as the formation of fine holes and channels in the plating surface of the substrate caused by oxygen gas and the generation of plating defects in the surface.

With the construction described above, the plating solution Q flows through the plating solution chamber 120 level to the plating surface of the substrate 113. This method enables the plating bath 110 to be produced with a smaller depth than plating baths using the conventional face down method that shoots a plating solution jet directly at the substrate. Accordingly, a plurality of plating baths 110 can be provided next to each other.

As described above, a flattened plating solution chamber is provided below the plating surface of the substrate and a plating solution inlet for allowing plating solution to flow into the plating solution chamber and a plating solution outlet to enable plating solution to flow out of the chamber are provided on either side of the substrate and outside the periphery of the substrate. With this configuration, plating in the plating solution chamber flows level and in contact with the plating surface of the substrate. Accordingly, the relative speed of the plating solution to the plating surface is uniform across the entire surface of the substrate. Additives in the plating solution are uniformly adsorbed, improving implanting properties for fine holes and channels in the substrate to achieve a uniform plating thickness. Further, since the plating solution flows level to the plating surface on the bottom of the substrate, the depth of the plating bath can be made small.

Also, an anode chamber is provided below the plating solution chamber and separated from the plating solution chamber by an ion exchange film or neutral porous diaphragm, through which plating solution or another conductive liquid flows. This configuration prevents the surface of the anode from being oxidized and prevents unusual consumption of additives in the plating solution. Further, oxygen gas generated from the surface of the anode is prevented by the ion exchange film or neutral porous diaphragm from reaching the substrate. Accordingly, this configuration can prevent defects of plating layer from forming plating in fine holes and channels in the surface of the substrate.

By providing a mechanism for rotating the substrate, the substrate can be rotated in the plating solution at a slow speed with the plating surface facing downward to form a plating film of uniform thickness on the substrate. After the plating is completed, the substrate can be raised out of the plating solution and rotated at a fast speed to shake off excess plating solution into the plating bath, thereby reducing the amount of contamination from plating solution on the outside of the plating bath.

Further, the overall surface configuration of the plating apparatus can be made smaller by providing a plurality of plating baths in a stage. Hence, it is possible to reduce the required installation space.

Figure 11:
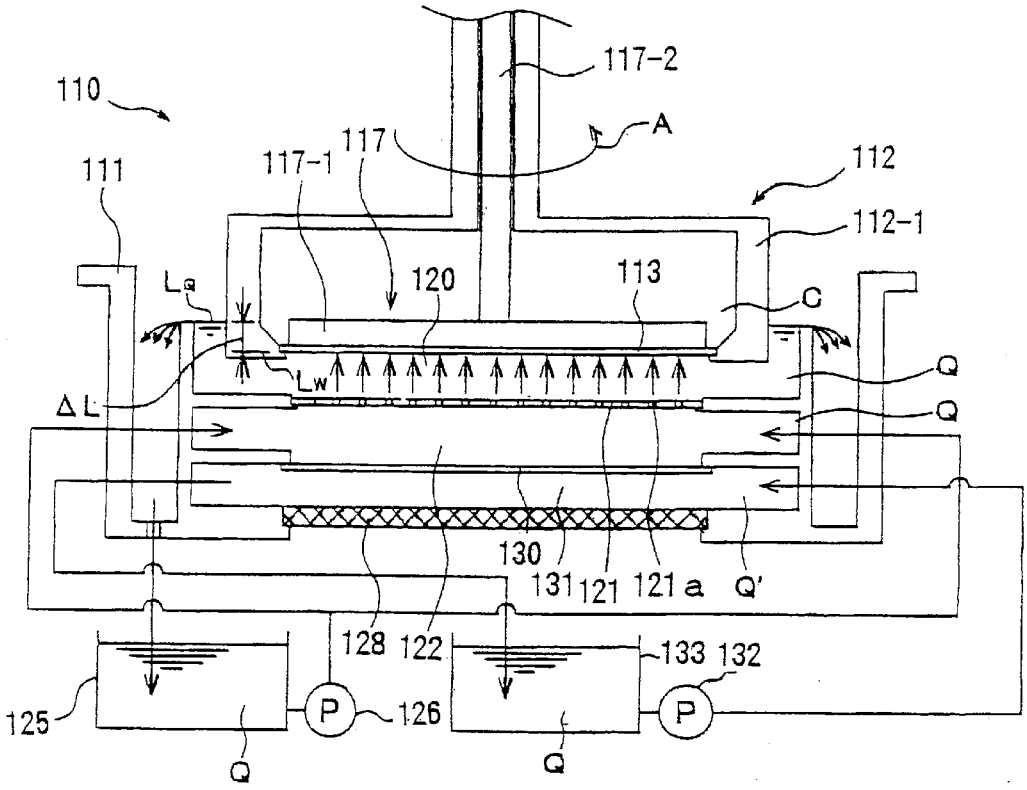
FIG. 11 shows another embodiment of a substrate plating apparatus.

FIG. 11 shows another embodiment of a plating bath according to the present invention. As shown in the diagram, the structure from plating retainer 112 and above is the same as that in FIG. 9. Therefore, a description of that section will be omitted. A flattened plating solution chamber 120 is provided below the retaining member 112-1, that is, below the plating surface of the substrate 113 exposed from the opening 112-1*a*. A flat plating-solution introducing chamber 122 is disposed beneath the plating solution chamber 120. A porous plate 121 having a plurality of pores 121*a* separates the plating solution chamber 120 from the plating-solution introducing chamber 122. A collecting gutter 123 provided around the plating solution chamber 120 collects plating solution Q that overflows from the plating solution chamber 120.

Plating liquid Q collected from the plating solution chamber 120 is returned to the plating solution tank 125. The pump 126 pumps plating solution Q from the plating solution tank 125 and introduces it horizontally from both sides into the plating-solution introducing chamber 122. After being introduced into both sides of the plating-solution introducing chamber 122, the plating solution Q flows into the plating solution chamber 120 via the pores 121*a* formed in the porous plate 121 becoming jets perpendicular to the substrate 113. The distance between the substrate 113 and the porous plate 121 is 5–15 mm. The jet streams of plating solution Q forced through the pores 121*a* are maintained in a uniform upward direction to contact the plating surface of the substrate 113. Plating solution Q that overflows from the plating solution chamber 120 is collected by the collecting gutter 123 and returned to the plating solution tank 125. In other words, plating solution Q is circulated between the plating solution chamber 120 and the plating solution tank 125.

The plating bath 110 is further provided with the anode chamber 131 below the plating-solution introducing chamber 122 for introducing plating solution or conductive liquid Q' into the plating-solution introducing chamber 122 via an ion exchange film or neutral porous diaphragm 130 and the anode 128 on the bottom of the anode chamber 131. The pump 132 introduces plating solution or conductive liquid Q' from the liquid tank 133 into the anode chamber 131. After flowing through the anode chamber 131, the plating solution or conductive liquid Q' is returned to the liquid tank 133. In other words, plating solution or conductive liquid Q' is circulated between the anode chamber 131 and the liquid tank 133.

As described above, the anode chamber 131 is disposed beneath the plating-solution introducing chamber 122 and separated from the same by the ion exchange film or neutral porous diaphragm 130. Plating liquid or conductive liquid Q' is flowed through the anode chamber 131. With this configuration, it is possible to prevent oxidation on the surface of the anode 128 when using an insoluble anode 128. Further, oxide gas generated from the surface of the anode 128 is blocked by the ion exchange film or neutral porous diaphragm 130 and prevented from reaching the plating surface of the substrate 113. Accordingly, this construction can prevent unusual consumption of additives in the plating solution Q, as well as the defects by formation of plating layer at fine holes and channels in the plating surface of the substrate caused by oxygen gas.

As described above, the plating bath is provided with a plating solution chamber formed between the substrate and the porous plate opposite and separated a predetermined distance below the substrate; and a flattened plating-solution introducing chamber formed below the porous plate. The plating solution flows horizontally into the plating-solution introducing chamber and is forced through the plurality of holes in the porous plate to form flows of plating solution perpendicular to the plating surface of the substrate. Accordingly, by appropriately setting the distance between the porous plate and the substrate, it is possible to form a flattened plating bath with a shallow depth, without requiring to increase the distance above the plating solution or to rectify the flow.

An anode chamber is provided below the plating-solution introducing chamber and separated from the introducing chamber by an ion exchange film or neutral porous diaphragm. Plating solution or another conductive liquid is flowed through the anode chamber. This configuration prevents the anode surface from being oxidized and prevents the unusual consumption of additives in the liquid. Further, generated oxygen gas is blocked by the ion exchange film or neutral porous diaphragm and prevented from contacting the substrate, thereby preventing defects being formed in the plating layer at fine holes and channels in the surface of the substrate.

By providing a mechanism for rotating the substrate in the plating solution at a slow speed with the plating surface facing downward, the plating surface of the substrate is uniformly contacted by plating solution to form a plating film of uniform thickness on the substrate. After the plating process is completed, the mechanism lifts the substrate out of the plating solution and rotates the substrate at a fast speed to shake off excess plating solution into the plating bath, thereby reducing the amount of contamination from plating solution on the outside of the plating bath.

By setting the distance between the substrate and porous plate at 5–15 mm, the rotation of the substrate forces liquid toward the periphery of the substrate by the viscosity of the liquid. This effect lowers the pressure toward the center of the substrate and increases the flow of liquid through the center of the porous plate, thereby achieving a uniform vertical component of velocity over the entire surface of the substrate. Accordingly, it is possible to produce a plating bath with a shallow depth, since there is no need to increase the depthwise distance for the ascending liquid current as in the prior art.

The footstep of the overall apparatus can be decreased by providing a plurality of plating baths next to one another in a stage, thereby reducing the amount of space required for installation.

Figure 12A:
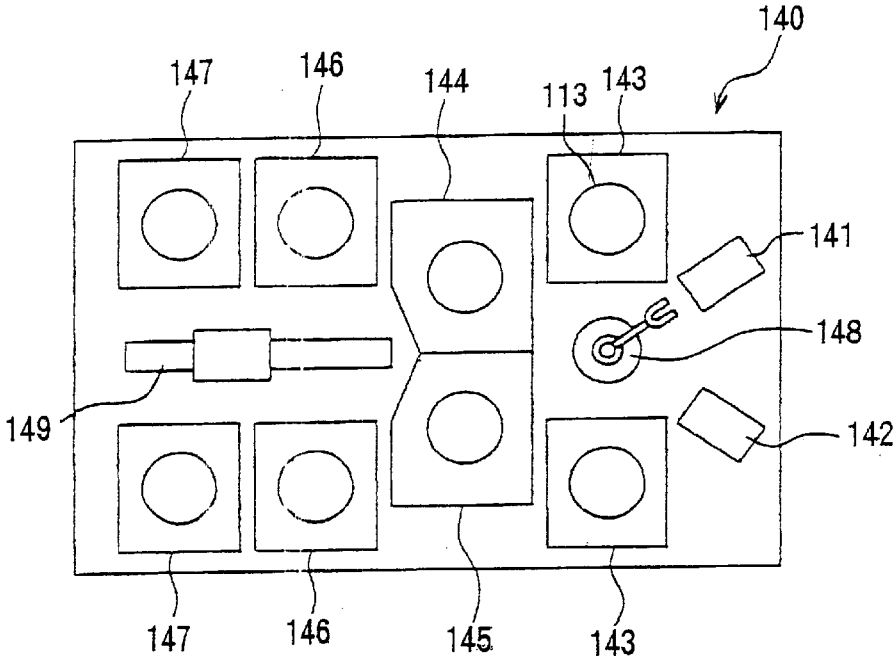
FIGS. 12A and 12B are a plan view and a side view respectively showing the overall structure of the substrate plating apparatus employing the plating bath.
Figure 12B:
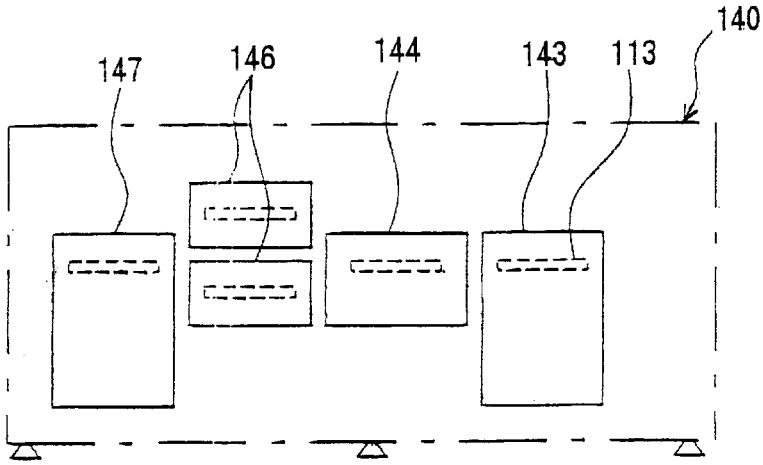

FIGS. 12A and 12B show the overall structure of a plating apparatus employing the plating baths 110 described above. FIG. 12A is a plan view of the apparatus, while FIG. 12B is a side view. As shown the diagrams, a plating apparatus 140 comprises a loading section 141, an unloading section 142, cleaning and drying vessels 143, a loading stage 144, a coarse washing vessel 145, plating stages 146, preprocess vessesl 147, a first robot 148, and a second robot 149. Each of the plating stages 146 includes a combination of two plating baths 110 as configured in FIG. 9 or FIG. 11. Hence, the entire plating apparatus is provided with four plating baths 110. This construction is possible because the plating bath 110 has a more shallow depth than the plating bath of the prior art.

With the plating apparatus 140 described above, substrates 113 are contained in a cassette deposited on the loading section 141. The first robot 148 extracts one substrate 113 at a time and transfers it to the loading stage 144. Here, the second robot 149 transfers the substrate 113 at the loading stage 144 to one of the preprocess vessels 147, where the substrate 113 is preprocessed. Next, the second robot 149 transfers the preprocessed substrate 113 to a plating bath 110 in one of the plating stages 146, where the substrate 113 undergoes a plating process. After the plating process is completed, the second robot 149 transfers the substrate 113 to the coarse washing vessel 145 for washing. Next, the first robot 148 transfers the substrate 113 to the cleaning and drying vessels 143 to be washed and dried, after which the first robot 148 transfers the substrate 113 to the unloading section 142.

Since the plating bath 110 of the present invention is provided with a plating solution chamber 120 beneath the plating surface of the substrate 113 through which plating solution Q flows horizontally across the plating surface, the depth of the plating bath 110 can be shallow, enabling a plurality (two in this case) of plating baths 110 to be provided together. The installation space of the entire plating apparatus can be decreased since the depth of two plating baths 110 is equivalent to one plating bath using the face down method of the prior art. In other words, when using plating baths of the prior art to construct a plating apparatus with four plating baths, only one plating bath can be provided in each plating stage 146. Therefore, the installation area required for the plating stages 146 would be twice as large as that shown in FIG. 12B.

While the invention has been described in detail with reference to specific embodiments thereof, it would be apparent to those skilled in the art that many modifications and variations may be made therein without departing from the scope of the invention, the scope of which is defined by the attached claims. For example, the embodiments described above used electrolytic plating in the plating apparatus of the present invention, but the present invention can also apply to an apparatus conducting electroless plating. In addition to using copper sulfate plating solution for the plating solution Q to conduct copper plating, it is also possible to use other plating solution to conduct a plating process with a different metal.

Industrial Applicability

The present invention is applicable to the semiconductor industry, since the substrate plating can be conducted so as to form a fine wiring layer on a semiconductor wafer.

What is claimed is:

1. A substrate plating apparatus for plating a substrate in a plating bath containing a plating solution when an anode is disposed in the plating bath opposite the substrate, the substrate plating apparatus comprising:

an ion exchange film or neutral porous diaphragm to be disposed between the substrate and anode in the plating bath for dividing the plating bath into a substrate region and an anode region; and shutoff valves to serve as an inlet and outlet for plating solution in the anode region, wherein plating solution from the anode region is to flow through one of the shutoff valves and merge with plating solution flowing from the substrate region.

2. The substrate plating apparatus according to claim 1, wherein the anode is a soluble anode and the ion exchange film is a cationic exchange film through which only ions dissolved from the soluble anode can pass.

3. The substrate plating apparatus according to claim 1, further comprising a filter in fluid communication with the one of the shutoff valves for filtering plating solution flowing from the anode region.

4. A substrate plating apparatus for plating a substrate in a plating bath containing a plating solution when an insoluble anode is disposed in the plating bath opposite the substrate, the substrate plating apparatus comprising:

a diaphragm formed of an ion exchange film or neutral porous diaphragm to be disposed between the substrate and the insoluble anode in the plating bath for dividing the plating bath into a substrate region and an anode region; and a plate that contacts the ion exchange film or neutral porous diaphragm and is to serve as a shielding plate for correcting primary current distribution between the insoluble anode and substrate.

5. The substrate plating apparatus according to claim 4, further comprising circulating devices for separately circulating the plating solution in the substrate region and anode region.

6. A substrate plating apparatus for plating a substrate in a plating bath containing plating solution when an anode is disposed in the plating bath opposite the substrate, the plating apparatus comprising:

an ion exchange film or neutral porous diaphragm to be disposed between the substrate and anode in the plating bath, whereby the ion exchange film or neutral porous diaphragm is to divide the plating bath into a substrate region and an anode region;

a plating solution chamber to be disposed under a plating surface of the substrate when the substrate is disposed with its plating surface facing downward;

a plating solution inlet and plating solution outlet to be disposed in opposition to each other one on either side of the periphery of the substrate, with the plating solution inlet enabling an inflow of plating solution into the plating solution chamber and the plating solution outlet enabling an outflow of plating solution from the plating solution chamber, such that plating solution in the plating solution chamber can flow parallel to and in contact with the plating surface of the substrate;

an anode chamber provided under the plating solution chamber via the ion exchange film or neutral porous diaphragm, with plating solution or another conductive liquid to flow in the anode chamber; and an anode disposed at the bottom of the anode chamber to oppose the substrate via the ion exchange film or neutral porous diaphragm.

7. The substrate plating apparatus according to claim 6, further comprising a substrate rotating mechanism for rotating the substrate while the plating surface of the substrate faces downward in the plating bath.

8. The substrate plating apparatus according to claim 7, wherein the substrate is to be rotated by the substrate rotating mechanism in the plating bath at a speed of 1–10 rpm.

9. The substrate plating apparatus according to claim 6, further comprising a plating stage to be provided with a plurality of plating baths.

10. A substrate plating apparatus for plating a substrate in a plating bath containing plating solution when an anode is disposed in the plating bath opposite the substrate and the substrate has its plating surface facing downward, the plating apparatus comprising:

an ion exchange film or neutral porous diaphragm to be disposed between the substrate and anode in the plating bath, whereby the ion exchange film or neutral porous diaphragm is to divide the plating bath into a substrate region and an anode region;

a plating solution chamber to be formed between the substrate and the ion exchange film or neutral porous diaphragm;

a porous plate having a plurality of holes;

a plating solution introducing chamber formed below the porous plate, wherein plating solution is to be introduced into the plating solution introducing chamber in a horizontal direction and forced through the holes in the porous plate to form flows orthogonal to the plating surface of the substrate;

an anode chamber provided under the plating solution chamber via the ion exchange film or neutral porous diaphragm; and an anode disposed at the bottom of the anode chamber to oppose the substrate via the ion exchange film or neutral porous diaphragm and the porous plate, wherein the plating solution or another conductive liquid is to flow in the anode chamber.

11. The substrate plating apparatus according to claim 10, further comprising a substrate rotating mechanism for rotating the substrate while the plating surface of the substrate faces downward in the plating bath.

12. The substrate plating apparatus according to claim 10, wherein the distance between the substrate and the porous plate is to be 5–15 mm.

13. The substrate plating apparatus according to claim 10, further comprising a plating stage to be provided with a plurality of plating baths.

14. A substrate plating apparatus for plating a substrate, comprising:

a plating bath capable of containing a plating solution when an insoluble anode is disposed in the plating bath opposite a plating surface of a substrate when the substrate is disposed with the plating surface facing downward; and a circulating vessel or dummy vessel provided separate from the plating bath, with a soluble anode and a cathode being disposed in the circulating vessel or dummy vessel, and an anion exchange film or selective cation exchange film being disposed between the soluble anode and the cathode for isolating the soluble anode and cathode, wherein metal ions are to be generated in the circulating vessel or dummy vessel by flowing current between the soluble anode and the cathode, and the generated metal ions are to be supplied to the plating bath.

15. The substrate plating apparatus according to claim 14, further comprising a sulfuric acid source to supply sulfuric acid so as to maintain liquid at a uniform conductivity in the circulating vessel or dummy vessel.

16. The substrate plating apparatus according to claim 15, further comprising a substrate rotating mechanism for rotating the substrate while the plating surface of the substrate faces downward in the plating bath.

17. The substrate plating apparatus according to claim 15, further comprising a plating stage provided with a plurality of plating baths.

18. The substrate plating apparatus according to claim 14, further comprises a plurality of plating baths, and an amount of current to be flowed between the substrate and the insoluble anode in each of the plating baths is to be equal to an amount of current flowed between the soluble anode and the cathode in the circulating vessel or dummy vessel.

19. The substrate plating apparatus according to claim 14, wherein the insoluble anode in the plating bath is to be connected to the cathode in the circulating vessel or dummy vessel when the substrate in the plating bath is connected to the soluble anode in the circulating vessel or dummy vessel, and the current to be flowed between the insoluble anode and the substrate in the plating bath is equal to the current to be flowed between the soluble anode and the cathode in the circulating vessel or dummy vessel.

20. A substrate plating apparatus for plating a substrate, comprising:

a plating bath to contain a plating solution when an anode is disposed in the plating bath opposite a substrate and the substrate is disposed with its plating surface facing downward; and an ion exchange film or neutral porous diaphragm to be disposed between the substrate and the anode in the plating bath, whereby the ion exchange film or neutral porous diaphragm is to divide the plating bath into a substrate region and an anode region.

21. The substrate plating apparatus according to claim 20, wherein the anode is a soluble anode and the ion exchange film is a cationic exchange film through which only ions dissolved from the soluble anode can pass.

22. The substrate plating apparatus according to claim 20, further comprising shutoff valves to serve as an inlet and outlet for plating solution in the anode region, wherein plating solution from the anode region is to flow through one of the shutoff valves and merge with plating solution flowing from the substrate region.

23. The substrate plating apparatus according to claim 22, further comprising a filter in fluid communication with the one of the shutoff valves.

24. A substrate plating apparatus for plating a substrate, comprising:

a plating bath to contain a plating solution when an insoluble anode is disposed in the plating bath opposite a substrate and the substrate is disposed with its plating surface facing downward; and an ion exchange film or neutral porous diaphragm to be disposed between the substrate and the insoluble anode in the plating bath, whereby the ion exchange film or neutral porous diaphragm is to divide the plating bath into a substrate region and an insoluble anode region.

25. The substrate plating apparatus according to claim 24, further comprising a plate that contacts the ion exchange film or neutral porous diaphragm and is to serve as a shielding plate for correcting primary current distribution between the insoluble anode and substrate.

26. The substrate plating apparatus according to claim 24, further comprising circulating devices for separately circulating the plating solution in the substrate region and the insoluble anode region.

27. The substrate plating apparatus according to claim 24, wherein plating bath comprises:

a plating solution chamber to be disposed under the plating surface of the substrate;

a plating solution inlet and plating solution outlet to be disposed in opposition to each other one on either side of the periphery of the substrate, with the plating solution inlet enabling an inflow of plating solution into the plating solution chamber and the plating solution outlet enabling an outflow of plating solution from the plating solution chamber, such that plating solution in the plating solution chamber can flow parallel to and in contact with the plating surface of the substrate;

an anode chamber provided under the plating solution chamber via the ion exchange film or neutral porous diaphragm, wherein plating solution or another conductive liquid is to flow in the anode chamber; and an anode disposed at the bottom of the anode chamber to oppose the substrate via the ion exchange film or neutral porous diaphragm.

28. The substrate plating apparatus according to claim 24, further comprising a substrate rotating mechanism for rotating the substrate while the plating surface of the substrate faces downward in the plating bath.

29. The substrate plating apparatus according to claim 28, wherein the substrate is to be rotated by the substrate rotating mechanism in the plating bath at a speed of 1–10 rpm.

30. The substrate plating apparatus according to claim 24, further comprising a plating stage provided with a plurality of plating baths.

31. The substrate plating apparatus according to claim 24, wherein the plating bath comprises:

a plating solution chamber to be formed between the substrate and the ion exchange film or neutral porous diaphragm;

a porous plate having a plurality of holes;

a plating solution introducing chamber formed below the porous plate, wherein plating solution is to be introduced into the plating solution introducing chamber in a horizontal direction and forced through the holes in the porous plate to form flows orthogonal to the plating surface of the substrate;

an anode chamber provided under the plating solution chamber via the ion exchange film or neutral porous diaphragm; and an anode disposed at the bottom of the anode chamber to oppose the substrate via the ion exchange film or neutral porous diaphragm and the porous plate, wherein plating solution or another conductive liquid is to flow in the anode chamber.

32. A substrate plating apparatus for plating a substrate, comprising:

a loading section for loading a substrate;

a robot for conveying the substrate;

a plating bath capable of containing plating solution when an anode is disposed in the plating bath opposite the substrate;

a circulating vessel or dummy vessel provided separate from the plating bath, with a soluble anode and a cathode being disposed in the circulating vessel or dummy vessel, and an anion exchange film or selective cation exchange film being disposed between the soluble anode and the cathode for isolating the soluble anode and the cathode, wherein metal ions are to be generated by flowing current between the soluble anode and the cathode, and the generated metal ions are to be supplied to the plating bath;

a coarse washing vessel for coarsely washing the substrate after a plating process is completed; and a cleaning and drying vessel for cleaning and drying the substrate after coarse washing of the substrate is completed.

33. A substrate plating apparatus for plating a substrate, comprising:

a loading section for loading a substrate;

a robot for conveying the substrate;

a plating bath capable of containing plating solution when an anode is disposed in the plating bath opposite the substrate;

an anion exchange film or selective cation exchange film to be disposed between the anode and the substrate for isolating the anode and the substrate;

a coarse washing vessel for coarsely washing the substrate after a plating process is completed; and a cleaning and drying vessel for cleaning and drying the substrate which is plated in the plating bath.

34. A substrate plating apparatus for plating a substrate, comprising:

a loading section for loading a substrate;

a robot for conveying the substrate;

a plating bath capable of containing plating solution when an insoluble anode is disposed in the plating bath opposite the substrate;

an anion exchange film or selective cation exchange film to be disposed between the insoluble anode and the substrate for isolating the insoluble anode and the substrate;

a coarse washing vessel for coarsely washing the substrate after a plating process is completed; and a cleaning and drying vessel for cleaning and drying the substrate after coarse washing of the substrate is completed.

* * * * *